US010260218B2

(12) United States Patent
Moore

(10) Patent No.: US 10,260,218 B2
(45) Date of Patent: Apr. 16, 2019

(54) SPRAY HEAD

(71) Applicant: Hornbeam Ivy Ltd., Somerset (GB)

(72) Inventor: James Moore, Somerset (GB)

(73) Assignee: Hornbeam Ivy Ltd., Somerset (GB)

( * ) Notice: Subject to any disclaimer, the term of this patent is extended or adjusted under 35 U.S.C. 154(b) by 10 days.

(21) Appl. No.: 15/609,365

(22) Filed: May 31, 2017

(65) Prior Publication Data

US 2017/0362804 A1 Dec. 21, 2017

(30) Foreign Application Priority Data

Jun. 20, 2016 (GB) ..... 1610714.6

(51) Int. Cl.
*E03C 1/04* (2006.01)
*B05B 1/16* (2006.01)

(52) U.S. Cl.
CPC ..... *E03C 1/0405* (2013.01); *B05B 1/1645* (2013.01); *B05B 1/1654* (2013.01); *E03C 2001/0415* (2013.01)

(58) Field of Classification Search
CPC ..... E03C 1/0405
USPC ..... 4/678; 137/625.46
See application file for complete search history.

(56) References Cited

U.S. PATENT DOCUMENTS 7,717,131 B2 * 5/2010 Creswell ..... F16K 3/10 137/625.46
2005/0098658 A1 5/2005 Burke
2006/0163387 A1 7/2006 Erdely
2012/0298778 A1 11/2012 Chen

FOREIGN PATENT DOCUMENTS

GB 600855 A 4/1948
KR 2009-0006657 U 7/2009

OTHER PUBLICATIONS

GB Examination Report dated Dec. 15, 2017 in GB Application No. 1610714.6. 6 pages.

* cited by examiner

*Primary Examiner* — Lauren A Crane
(74) *Attorney, Agent, or Firm* — Duane Morris LLP; Manita Rawat

(57) ABSTRACT

A spray head suitable for mounting on a flexible hose, wherein the spray head comprises a rotary switching mechanism for permitting selection of either a stream flow (i.e. laminated flow) or a spray flow, e.g. by directing flow received from the hose through different outlet nozzles. By providing a compact rotary switching action, the spray head may overcome problems caused by wear or scale build up that are seen in push button or linear switching mechanisms.

13 Claims, 3 Drawing Sheets

SPRAY HEAD

CROSS-REFERENCE TO RELATED APPLICATION

This application claims the benefit of GB patent application no. 1610714.6 filed on 20 Jun. 2016.

BACKGROUND

Typical spray devices (sometimes known as hand sprays) include a spray head, e.g. similar to a shower head, for delivering fluid (e.g. water) flow through a nozzle. Such spray devices can be configured as a side spray, e.g. located next to the primary tap or taps of a kitchen sink, or removably mountable on the work surface (sink holding or containing surface). Alternatively, a spray device may be configured as a pull-down or lift-out spray directed mounted on the primary tap, which is typically a mixer tap. Each spray device may comprise a spray head, which typically includes a hand grip to allow the user to direct the flow as desired, and a flexible fluid delivery hose to allow more freedom of movement. Typically, known hand sprays are operable using a simple thumb switch, which controls a valve to stop or release fluid flow through the nozzle. The thumb switch allows controlled one-handed operation.

It is known for spray devices to be capable of outputting different types of flow, in a user selectable manner. US 2006/0163387 discloses a faucet spray head having a spout adaptor that has coaxially mounted aeration and spray unit, which are selectable based on a rotational position of the spray head mechanism in relation to the spout adaptor. Similarly, U.S. Pat. No. 7,717,131 discloses a diverter valve for mounting on a kitchen faucet to permit selective control over the flow of fluid from a fluid source to one of several fluid outlets.

SUMMARY

At its most general, the present disclosure provides a spray head suitable for mounting on a flexible hose, wherein the spray head comprises a rotary switching mechanism for permitting selection of either a stream flow (i.e. laminated flow) or a spray flow, e.g. by directing flow received from the hose through different outlet nozzles. By providing a compact rotary switching action, the disclosure may overcome problems caused by wear or scale build up that are seen in push button or linear switching mechanisms.

According to the disclosure, there is provided a spray head for mounting on a flexible hose, the spray head comprising: a fixed head portion mountable to the flexible hose; and a rotatable head portion mounted on the fixed head portion and rotatable relative to the fixed head portion about a rotation axis, wherein the fixed head portion comprises a fluid flow path for receiving an input flow from the flexible hose, the fluid flow path extending in the same direction as the rotation axis, wherein the rotatable head portion comprises a first nozzle for generating a first fluid flow type, a second nozzle for generating a second fluid flow type that is different from the first fluid flow type, a first flow path in fluid communication with the first nozzle, and a second flow path in fluid communication with the second nozzle, wherein the first flow path and the second flow path are separate from each other and each radially offset from the rotation axis, and wherein the rotatable head portion is rotatable relative to the fixed head portion to selectively provide fluid communication between the first flow path or the second flow path with the fluid flow path in the fixed head portion. The spray head is thus operable to select different flow types by rotating the rotatable head portion to bring different flow paths (and therefore different nozzles) into fluid communication with the fluid flow path.

The spray head may have a generally cylindrical form, e.g. having an axis that is aligned with a longitudinal axis of the hose. The spray head may thus appear as a compact continuation or termination of the hose.

The nozzles may be separate components, e.g. mounted next to each other in the rotatable head portion. The nozzles may be independently detachable, e.g. to enable easy replacement or to enable the same flow selection mechanism to be used with a variety of nozzle. In one example, the first fluid flow type may be stream flow, e.g. from an aerator-type nozzle, and the second fluid flow type may be a spray fluid flow, e.g. from a spray type nozzle. Other types of nozzle can be used. The disclosure is also not limited to two nozzles. There may be three, four or more nozzles in the rotatable head portion.

The fluid flow path in the fixed head portion may include a distal portion that is radially offset from the rotation head. The rotatable head portion may be rotatable relative to the fixed head portion to selectively align the first fluid flow path or the second fluid flow path with the distal portion of the fluid flow path. In other words, depending on the relative angular position of the rotatable head portion and the fixed head portion, the first fluid flow path or the second fluid flow path will be aligned with the distal portion of the fluid flow path.

As discussed below, each of the flow paths described herein may comprise one or a plurality of channels or passages formed through an otherwise impermeable element. The channels may be shaped or sized to permit the selective alignment contemplated herein. For example, the rotatable head portion may be rotatable relative to the fixed head portion between a first position in which the fluid flow path in the fixed head portion is in fluid communication with only the first flow path and a second position in which the fluid flow path in the fixed head portion is in fluid communication with only the second flow path.

The fixed head portion may be mountable to the flexible hose via a connector body. The fixed head portion may be secured to the connector body in a non-rotatable manner, e.g. via a splined connection or the like. The flexible hose may be mounted on the connector body in any suitable manner, e.g. fixed or flexible. For example, to prevent unwanted twisting of the hose, the hose may be rotatably coupled to the connector body.

The fixed head portion may comprise an axially extending tubular spindle, wherein the fluid flow path comprises an axially extending passage through the spindle. The connector body discussed above may be arranged to provide fluid communication between an input fluid flow from the hose and the axially extending passage in the spindle, e.g. by having each of the hose and the spindle mounted in the connector body. The connector body may include sealing elements arrange to ensure the junction between the hose and spindle is water tight, i.e. does not leak.

The rotatable head portion may comprise a flow director body rotatably mounted on the spindle. The flow director body may be a component in which the first flow path and second flow path are provided in a manner that allows their position to be rotated about the rotation axis. For example, the flow director body may be an inverted cup-shaped element coaxially mounted on the spindle to define a recess at a distal end of the axially extending passage. There may be two independent outlets from the cup-shaped elements, which correspond to the first flow path and second flow path respectively. Each outlet may feed a respective nozzle.

In one example, the fixed head portion comprises a first flow defining element and the rotatable head portion comprises a second flow defining element, wherein the fluid flow path includes a channel through the first flow defining element, wherein the first flow path comprises a first passage through the second flow defining element, and wherein the second flow path comprises a second passage through the second flow defining element. The first flow defining element and the second flow defining element may be overlaid, i.e. may overlap in the direction of fluid flow, such that relative rotation between the rotatable head portion and fixed head portion changes the relative angular position between the first flow defining element and the second flow defining element. As discussed above, the first passage and second passage in the second flow defining element and the channel in the first flow defining element may be shaped so that only one of the first passage or second passage can overlap with the channel at any given angular position.

The first flow defining element and the second flow defining element may comprise a pair of ceramic discs mounted in sliding contact with each other. This type of rotary interface is known in cartridge valves. Indeed, in one example, the fixed head portion and rotatable head portion may comprise relatively movable parts of a flow control cartridge valve, e.g. a ceramic cartridge valve. To facilitate operation, the cartridge valve may be enclosed in a casing, e.g. to improve a user's grip on the device. For example, the casing may comprise a distal part that is secured to the rotatable head portion and a proximal part that is secured to the fixed head portion. The first nozzle and the second nozzle may be mounted in the distal part of the casing.

In another aspect, the disclosure provides a spray apparatus for a kitchen sink, the spray apparatus comprising a flexible hose connectable to a water supply (e.g. a mains supply); and a spray head as defined above mounted on a distal end of the flexible hose.

BRIEF DESCRIPTION OF THE DRAWINGS

Examples of the disclosure are discussed below in detail with reference to the accompanying drawings, in which.

DETAILED DESCRIPTION

Figure 1:
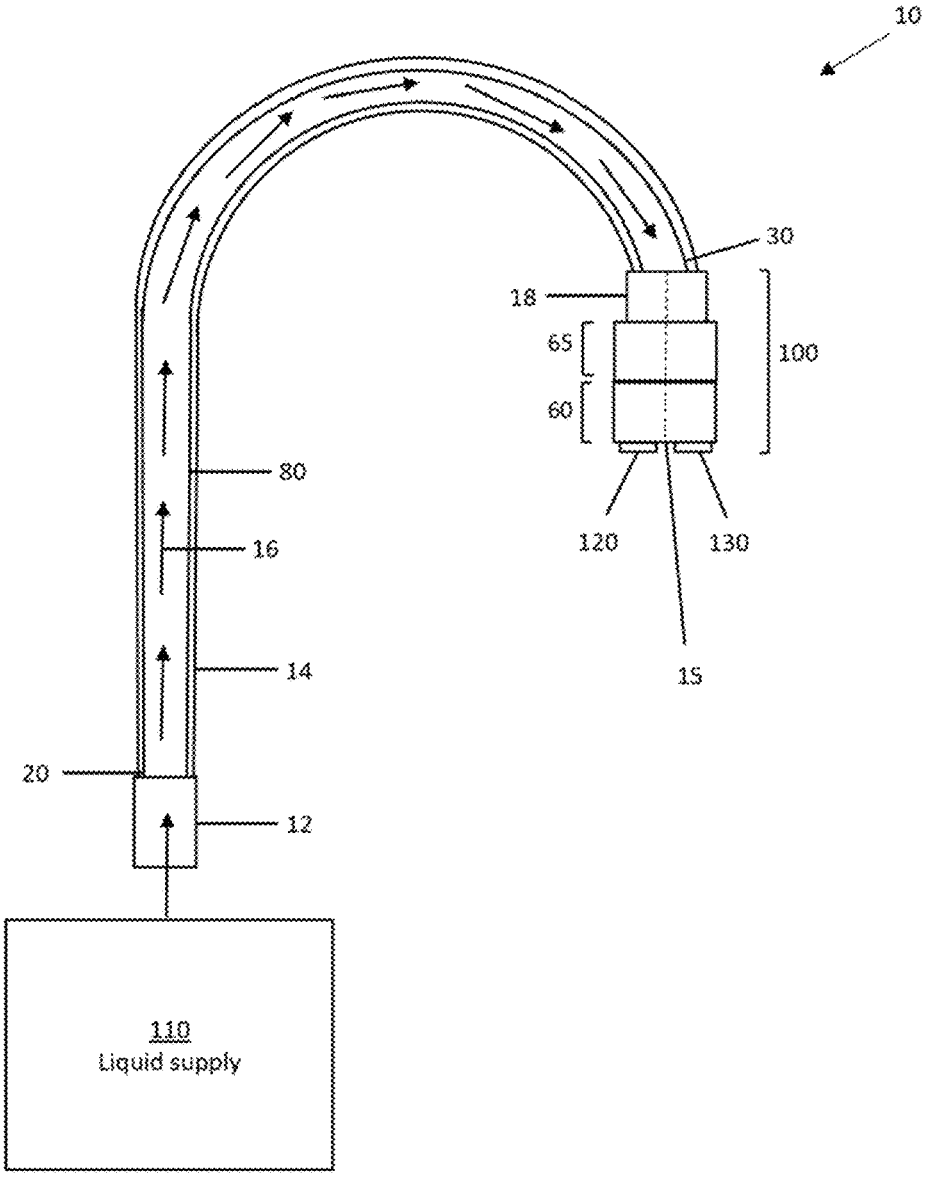
FIG. 1 is a schematic cross section of a spray head apparatus depicting an example of how an embodiment of the disclosure can be used.

In the description below, like reference numerals refer to similar or identical elements. It is to be understood that the disclosed embodiments are merely examples of the disclosure, which may be embodied in various forms.

The disclosure relates to a spray head apparatus for directing liquid through one of two (one of a plurality of) nozzles. In particular, the disclosure directs liquid from a liquid supply through a stream straightener nozzle or a spray nozzle. The stream straightener nozzle (directs) collimates the liquid into a straight stream. The spray nozzle directs (disperses) the liquid into a disperse spray. The spray head apparatus can be connected to a liquid supply point located in a kitchen or bathroom sink for example (but could also include e.g. a drinks fountain or a garden hose pipe etc.).

FIG. 1 is a schematic diagram of a spray head apparatus 10 for directing liquid from a liquid supply 110 through a hose 80 and into a spray head 100 which directs the liquid into one or more of a plurality of nozzles (two nozzles in this example discussed below) to produce different types of flow stream, e.g. a straight stream (i.e. unbroken flow) or a spray of liquid (i.e. flow of droplets).

The spray head apparatus 10 is connected by an installation connection 12 (e.g. a conventional water tight connector) to a liquid supply 110 located in a kitchen or bathroom. Once the liquid supply 110 is switched on via a mechanism suitable for controlling liquid flow, (e.g. a tap or a valve), liquid flows from the liquid supply 110 and along a flow channel defined by the hose 80, from a proximal hose end 20 to a distal hose end 30, in the direction shown by arrows 16. The hose 80 may be enclosed in a hose casing 14 to provide protection and support to the hose 80, as is conventional. The hose 80 can be made from flexible tubing, e.g. rubber, plastic, PTFE, or the like. The hose casing 14 can be made from a strong, liquid durable material, e.g. stainless steel, plastic, brass, or the like. The hose 80 and hose casing 14 may be flexible or rigid.

The spray head 100 is connected to the distal end 30 of the hose 80 at a spray head connector 18. The spray head connector 18 brings the flow channel defined by the hose 80 into fluid communication with an interior of the spray head 100. The spray head 100 comprises a fixed head portion 65 and a rotatable head portion 60. The fixed head portion 65 is secured so that is does not rotate relative to the spray head connector 18. The rotatable head portion 60 is rotatable relative to the fixed head portion about a rotation axis 15 that extends in a fluid flow direction through the spray head 100. In this embodiment, the fixed head portion 65 is located proximally to the rotatable head portion 60, but the opposite configuration is also possible.

As discussed in more detail below, the fixed head portion 65 has a flow path comprising at least one channel running therethrough, parallel to the axis of rotation 15. For example, the flow path in the fixed head portion 65 may have only one channel, e.g. for conveying a mixed flow from the liquid supply, but it may comprise two or more channels, e.g. for conveying hot and cold flows separately.

The rotatable head portion 60 comprises two (or more) independent flow paths (each of which may be defined by one or more channels) for directing fluid from the flow path in the fixed head portion 65 to a respective nozzle. For example, a first flow path by direct the fluid flow through a stream straightener nozzle 120, while a second flow path may direct the fluid flow through a spray nozzle 130. The stream straightener nozzle 120 may be configured (e.g. dimensioned) to cause liquid within a predetermined range of flow rate to exit the spray head 100 as a straight column. For example, the stream straightener nozzle 120 may be an aerator insert or the like. The spray nozzle 130 may be configured (e.g. dimensioned) to cause the output stream to consist of a plurality of separate jets which together form a spray.

Figure 2A:
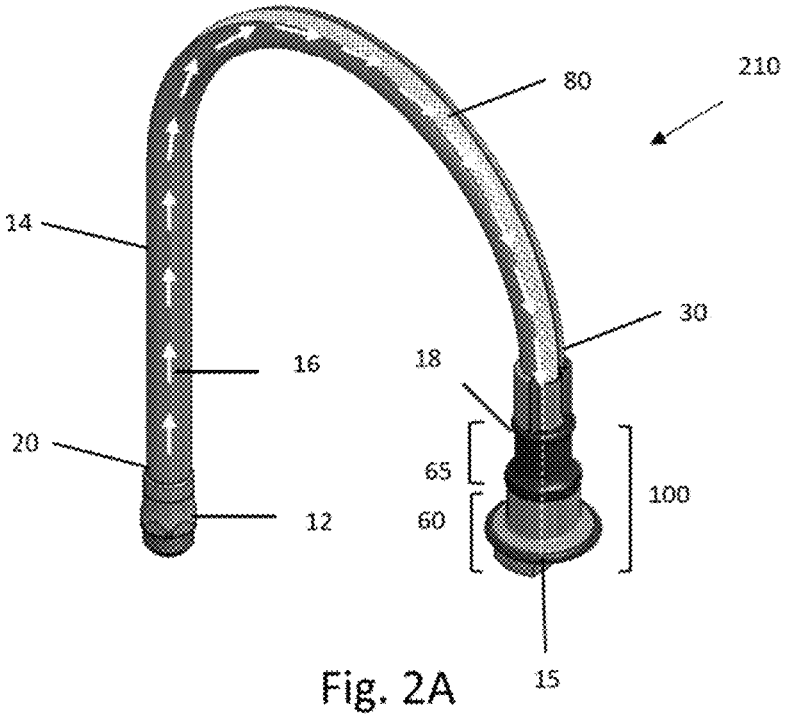
FIG. 2A is a perspective view of a spray head apparatus that is an embodiment of the disclosure.

FIG. 2A shows a perspective view of a spray head apparatus 210 that is similar to that shown in FIG. 1. The outer casing 14 is partly cut away to show the hose 80.

Figure 2B:
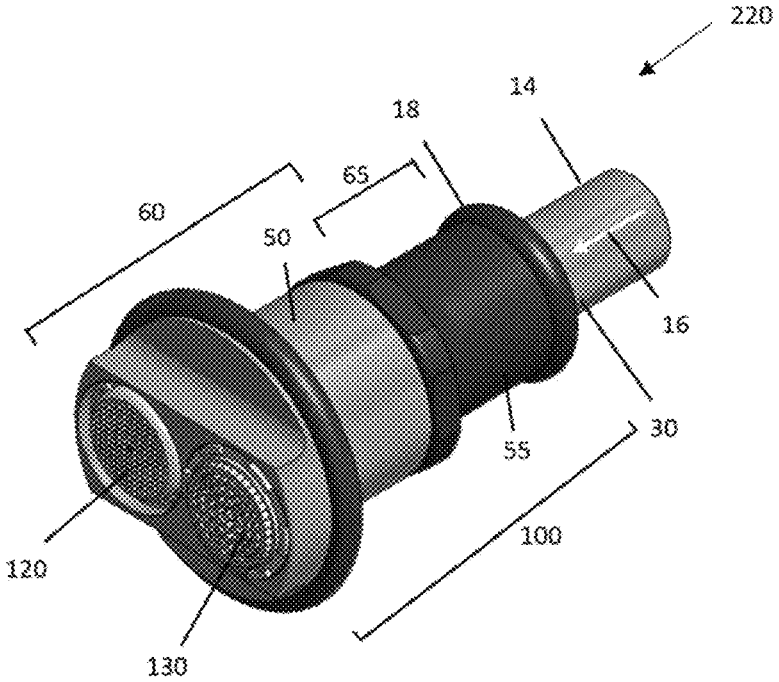
FIG. 2B is a perspective view of a spray head for use in the apparatus shown in FIG. 2A.

FIG. 2B shows a perspective view of a spray head 100 that can be used in the disclosure. The spray head 100 is connected by the spray head connector 18 to the hose 80 and the hose casing 14 at the distal hose end 30. Liquid flows into the spray head 100 in the direction shown by the arrow 16. Liquid flows into the fixed head portion 65 and then into the rotatable head portion 60 as discussed above. The fixed head portion 65 comprises a first casing 55 which may form a first gripping surface. The rotatable head portion 60 may comprise a second casing 50, which may form a second gripping surface. The first casing 55 and the second casing 50 can be made from the same or different materials. The materials may be strong and liquid durable, e.g. stainless steel, brushed stainless steel, brass, or the like.

The material for the first casing 55 and second casing 50 may be selected or patterned to facilitate grip by the user to aid rotation of the rotatable head portion 60 relative to the fixed head portion 65. For example, the casing may comprise a textured coating, e.g. made from rubber, plastic, stainless steel, brass, or the like.

In this embodiment, the rotatable head portion 60 can be rotated between two positions corresponding to different internal configurations of the flow path discussed above. In a first position, liquid exits the rotatable head portion 60 through a stream straightener nozzle 120. In a second position, liquid exits the rotatable head portion 60 through a spray nozzle 130. The stream straightener nozzle 120 and the spray nozzle 130 may be conventional components, e.g. such as those manufactured by NEOPERL GmbH, Germany.

Figure 3:
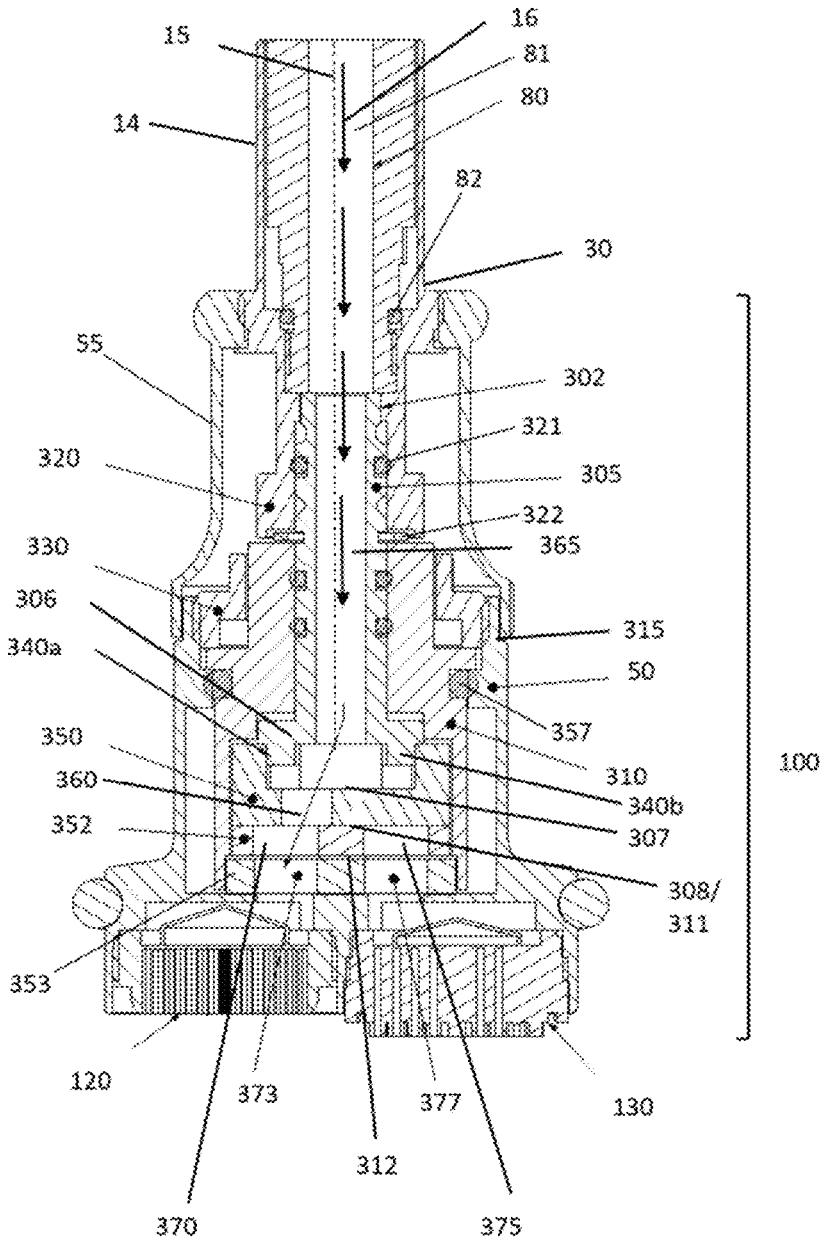
FIG. 3 is a schematic cross section of a spray head assembly that is an embodiment of the disclosure.

FIG. 3 is a cross-sectional view through the spray head 100 shown in FIG. 2B. The hose 80 defines an inlet flow path 81 through which liquid flows in the direction shown by arrow 16 into the spray head 100. In this example, the connector 18 comprises a connector housing 320 that is sealably mounted at the distal end of the hose. The connector housing 320 is a tubular body having a passageway therethrough for receiving a distal end of the hose 80 at a proximal end and a hollow spindle 305 at a distal end. The hose 80 may be secured in the connector housing 320 by an interference fit. A sealing ring 82 is mounted between the outer surface of the hose 80 and an inner surface of the connector housing 320 to provide a watertight seal. The spindle 305 may be mounted to the connector housing 320 via a splined connection, e.g. comprising a plurality of radial splines 302 projecting inwardly from the inner surface of the connector housing 320 to engage corresponding slots on the outer surface of the spindle 305. The splined connection ensures that the spindle 305 is fixed to the connector housing 320 in a rotational sense, i.e. the splined connection inhibits relative rotation between these components. A sealing ring 321 is mounted between the outer surface of the spindle 305 and an inner surface of the connector housing 320 to provide a watertight seal.

In this example, the spindle 305 corresponds to the fixed head portion 65 discussed above. The spindle 305 defines a fluid flow path 365 that is in fluid communication with the inlet flow path 81.

A flow director body 310 is rotatably mounted on a distal portion of the spindle. The flow director body 310 has a proximal portion having a passageway therein through which the spindle 302 passes. A pair of sealing rings 323, 324 are mounted between the outer surface of the spindle 305 and an inner surface of the passageway to provide a watertight seal. A washer 322 is mounted around the spindle 305 between a proximal end of the flow director body 310 and a distal end of the connector housing 320 to facilitate relative rotation therebetween.

The flow director body 310 has a inverted cup shape, which defines a recess for carrying a pair of ceramic discs 350, 352. A first ceramic disc 350 is non-rotatably connected to a distal end 306 of the spindle 305 by a pair of axially extending pegs 340*a*, 340*b*. The first ceramic disc 350 has a axial channel 360 extending therethrough that is located in an offset position relative to the rotation axis 15. The axial channel 360 is in fluid communication with the fluid flow path 365 through the spindle 305, whereby liquid flows into the first ceramic disc channel 360 from the fluid flow path 365 when the liquid supply 110 is initiated.

A second ceramic disc 352 is mounted in the flow director body 310 and rotates with it relative to the spindle 302. The second ceramic disc 352 has two axial channels 370, 375 formed therethrough, both at location that are radially offset from the rotation axis 15.

An outlet cover 353 is mounted over the mouth of the recess formed by the flow director body 310. The outlet cover 353 has a pair of axial outlet channels 373, 377 formed therein. The outlet cover 353 is mounted to align each outlet channel 373, 377 with a respective one of the first channel 370 and second channel 375. As illustrated in FIG. 3, the first channel 370 in the second ceramic disc 352 aligns with a first outlet channel 373, while the second channel 375 in the second ceramic disc 352 aligns with a second outlet channel 377.

In this example, the flow director body 310 may correspond to the rotatable head portion 65 discussed above. The spindle 305, flow director body 310, ceramic discs 350, 352, and outlet cover 353 may be provided by a conventional ceramic cartridge valve, such as those manufactured by Flühs Drehtechnik GmbH. However, the disclosure proposes a use configuration for such valves that is unconventional. Rather than fixed the valve body and connecting the spindle to an actuator (e.g. tap handle or the like), the disclosure proposes fixing the spindle and instead using the valve body (flow director body) as the actuatable component.

A first casing 50 is mounted on and fixed to the flow director hosing 310 by a retaining ring 330 and a radially extending locator peg (not shown). The first casing 50 comprises a proximally facing cup portion for retaining the flow director body 310. The first casing 50 and flow director housing 310 therefore rotate as one piece relative to the spindle 305. A sealing ring 357 is mounted between the outer surface of the flow director body 310 and an inner surface of the first casing 50 to provide a watertight seal.

The first casing 50 has a distal end surface in which a pair of nozzles 120, 130 are mounted. The nozzles 120, 130 may be integrally formed in the casing, or may be independent components that are mounted therein. The pair of nozzles 120, 130 are each offset from the rotation axis 15 and aligned with a respective one of the outlet channels 373, 377. In this example, the pair of nozzles comprise a stream straightener nozzle 120 fixed in alignment with first outlet channel 373 and a spray nozzle 130 fixed in alignment with second outlet channel 377.

When the rotatable head portion casing 50 is rotated by the user, the outlet channels 373, 377 and the nozzles 120, 130 are rotated relative to the spindle 305 (and therefore relative to the hose 80) to enable the user to select between a stream output flow and a spray output flow.

A second casing 55 is mounted between a distal end of the hose 80 and a proximal end of the first casing 50. The second casing 55 may be a moulded element, e.g. made from silicone rubber or the like. The second casing 55 may be secured in a non-rotatable manner to the connector housing 320. It may be overmoulded thereon. The second casing 55 may engage the first casing 50 at a sliding interface 315 that permits relative rotation between these components about the rotation axis 15.

In use, the spray head 100 is adjustable between two main positions, depending on the relative rotational position of the flow director body 310 relative to the spindle 305.

In a first position, the axial channel 360 in the first ceramic disc 350 is aligned with the first channel 370 in the second ceramic disc 352, whereby liquid flows from the fluid flow path 365 into the axial channel 360 then into the first channel 370 in the second ceramic disc 352 and thence into first outlet 373 and through nozzle 120.

In a second position, the axial channel 360 in the first ceramic disc 350 is aligned with the second channel 375 in the second ceramic disc 352, whereby liquid flows from the fluid flow path 365 into the axial channel 360 then into the second channel 375 in the second ceramic disc 352 and thence into second outlet 377 and through nozzle 130.

The embodiments of the disclosure discussed above provide a mechanism in which rotary action is used to switch between liquid exiting the spray head 100 by the stream straightener nozzle 120, and liquid exiting the spray head 100 by the spray nozzle 130. The use of rotary action for this purpose can be advantageous when compared with conventional push button or axial switching actions because it may provide the product with a greater life expectancy.

What is claimed is:

1. A spray head for mounting on a flexible hose, the spray head comprising:

a fixed head portion mountable to the flexible hose; and a rotatable head portion mounted on the fixed head portion and rotatable relative to the fixed head portion about a rotation axis, wherein the fixed head portion comprises a fluid flow path for receiving an input flow from the flexible hose, the fluid flow path extending in the same direction as the rotation axis, wherein the rotatable head portion comprises a first nozzle for generating a first fluid flow type, a second nozzle for generating a second fluid flow type that is different from the first fluid flow type, a first flow path in fluid communication with the first nozzle, and a second flow path in fluid communication with the second nozzle, wherein the first flow path and the second flow path are separate from each other and each radially offset from the rotation axis, wherein the rotatable head portion is rotatable relative to the fixed head portion to selectively provide fluid communication between the first flow path or the second flow path with the fluid flow path in the fixed head portion, and wherein the fixed head portion and the rotatable head portion are provided by a flow control cartridge valve that comprises a flow director body and a tubular spindle rotatably mounted to the flow director body, wherein the fixed head portion is the tubular spindle and the rotatable head portion is the flow director body.

2. A spray head according to claim 1, wherein the first fluid flow type is stream flow and the second fluid flow type is spray fluid flow.

3. A spray head according to claim 1, wherein the fluid flow path in the fixed head portion includes a distal portion that is radially offset from the rotation head, and wherein the rotatable head portion is rotatable relative to the fixed head portion to selectively align the first fluid flow path or the second fluid flow path with the distal portion of the fluid flow path.

4. A spray head according to claim 1, wherein the rotatable head portion is rotatable relative to the fixed head portion between a first position in which the fluid flow path in the fixed head portion is in fluid communication with only the first flow path and a second position in which the fluid flow path in the fixed head portion is in fluid communication with only the second flow path.

5. A spray head according to claim 1, wherein the fixed head portion is mountable to the flexible hose via a connector body, and wherein the fixed head portion is secured to the connector body in a non-rotatable manner.

6. A spray head according to claim 1, wherein the fluid flow path comprises an axially extending passage through the tubular spindle.

7. A spray head according to claim 1, wherein the flow director body is an inverted cup-shaped element coaxially mounted on the spindle to define a recess at a distal end of the axially extending passage.

8. A spray head according to claim 1, wherein the fixed head portion comprises a first flow defining element and the rotatable head portion comprises a second flow defining element, wherein the fluid flow path includes a channel through the first flow defining element, wherein the first flow path comprises a first passage through the second flow defining element, wherein the second flow path comprises a second passage through the second flow defining element, wherein the first flow defining element and the second flow defining element are overlaid such that relative rotation between the rotatable head portion and fixed head portion changes the relative angular position between the first flow defining element and the second flow defining element.

9. A spray head according to claim 8, wherein the first flow defining element and the second flow defining element comprise a pair of ceramic discs mounted in sliding contact with each other.

10. A spray head according to claim 1, wherein the flow control valve is a ceramic cartridge valve.

11. A spray head according to claim 10, wherein the cartridge valve is enclosed in a casing, the casing having a distal part that is secured to the rotatable head portion and a proximal part that is secured to the fixed head portion.

12. A spray head according to claim 11, wherein the first nozzle and the second nozzle are mounted in the distal part of the casing.

13. A spray apparatus for a kitchen sink, the spray apparatus comprising:

a flexible hose connectable to a water supply; and a spray head mounted on a distal end of the flexible hose, wherein the spray head comprises:

a fixed head portion mountable to the flexible hose; and a rotatable head portion mounted on the fixed head portion and rotatable relative to the fixed head portion about a rotation axis, wherein the fixed head portion comprises a fluid flow path for receiving an input flow from the flexible hose, the fluid flow path extending in the same direction as the rotation axis, wherein the rotatable head portion comprises a first nozzle for generating a first fluid flow type, a second nozzle for generating a second fluid flow type that is different from the first fluid flow type, a first flow path in fluid communication with the first nozzle, and a second flow path in fluid communication with the second nozzle, wherein the first flow path and the second flow path are separate from each other and each radially offset from the rotation axis, wherein the rotatable head portion is rotatable relative to the fixed head portion to selectively provide fluid communication between the first flow path or the second flow path with the fluid flow path in the fixed head portion, and wherein the fixed head portion and the rotatable head portion are provided by a flow control cartridge valve that comprises a flow director body and a tubular spindle rotatably mounted to the flow director body, wherein the fixed head portion is the tubular spindle and the rotatable head portion is the flow director body.

* * * * *